United States Patent [19]

Otubo et al.

[11] 3,947,190

[45] Mar. 30, 1976

[54] ELECTROPHOTOGRAPHIC APPARATUS FOR RECORDING IMAGES IN SUPERIMPOSED RELATIONSHIP

[75] Inventors: Osamu Otubo; Yujiro Tatsuno; Takatoshi Ikeda; Toshio Tsubaki, all of Hitachi, Japan

[73] Assignee: Hitachi, Ltd., Japan

[22] Filed: Mar. 13, 1974

[21] Appl. No.: 450,774

[30] Foreign Application Priority Data

Mar. 15, 1973 Japan ..... 48-30654

[52] U.S. Cl. ..... 355/3 R; 355/43

[51] Int. Cl.[2] ..... G03G 15/22

[58] Field of Search ..... 355/3 R, 3 SH, 7, 8, 10, 355/11, 20, 66, 10, 43, 45; 354/76

[56] References Cited

UNITED STATES PATENTS

| | | | |
|---|---|---|---|
| 3,088,386 | 5/1963 | Sugarman | 355/11 |
| 3,111,887 | 11/1963 | Alexander | 354/76 X |
| 3,490,842 | 1/1970 | Reick et al. | 355/10 |
| 3,600,082 | 8/1971 | Knechtel | 355/16 X |
| 3,644,930 | 2/1972 | Stange et al. | 101/DIG. 13 |
| 3,673,933 | 7/1972 | Hamann | 355/66 X |
| 3,722,995 | 3/1973 | Dahlquist | 355/20 X |
| 3,779,638 | 12/1973 | Ravera et al. | 355/3 R |

*Primary Examiner*—L. T. Hix
*Assistant Examiner*—Kenneth C. Hutchison
*Attorney, Agent, or Firm*—Craig & Antonelli

[57] ABSTRACT

An electrophotographic apparatus in which photosensitive paper travels through a substantially U-shaped path, comprises a base and a frame assembly provided on the base in a freely openable and closeable manner. Those components which require higher accuracy in mutual positioning, such as a paper feeding device, an exposure device, a cathode ray tube, a cathode ray tube optical device, a format and a format optical apparatus, are mounted on the frame assembly, and those components which require less accuracy in mutual positioning, such as a developing device, a motor and the like, are mounted on the base. The respective images from the format and the cathode ray tube are focused on an exposure plane of the exposure device in superimposed relation.

9 Claims, 10 Drawing Figures

ELECTROPHOTOGRAPHIC APPARATUS FOR RECORDING IMAGES IN SUPERIMPOSED RELATIONSHIP

The present invention relates to an electrophotographic apparatus, and more particularly to an apparatus for reproducing an image on the image screen of a cathode ray tube (hereinafter abbreviated to CRT) to such a degree as to be readable directly by eye.

Conventionally, the apparatus of this type includes side plates supported uprightly on a base, and the side plates fixedly support therebetween by means of screws a paper feeding means, an exposure device, an optical device, a developing device, a fixing device, a liquid storage device, motor control device, and so on, all these devices being then covered with an upper housing. In this respect, the apparatus has the following drawbacks:

1. Since the side plates for fixedly supporting a plurality of components are uprightly disposed on the base, insufficient flatness of the base results in poor optical alignment of the optical device and difficult alignment of the optical device relative to the exposure device.

2. It is difficult to replace any one of the components with another because they are stacked from the bottom.

3. Operations at the side of the side plates are required for fixing the components on the side plates, resulting in a requirement for space therefor.

4. The alignment of the optical system or the exposure plane requires the disassembling of the upper housing or predetermined components with the difficulty of maintenance and inspection.

5. When the apparatus is jammed with paper, the jammed paper cannot be removed therefrom with ease because the components are stacked one upon another.

Further, in the apparatus of this type, it is necessary to superimpose character information appearing on the CRT on stationary information on a slide (hereinafter referred to as a format) for synthetic recording on photosensitive paper. For the device to fulfil the requirement there has been known a COM (Computer Output on Microfilm), which, however, requires a microscope serving to make alignment of the two kinds of informations with one another, and is complicated and expensive in structure.

The apparatus according to the present invention which is intended to record the character information on the CRT to such an enlargement as to be readable directly by eye doesn't require such critical accuracy in alignment of the two pieces of information as the COM does, but actually requires an accuracy in the order of 1 mm measured on the recording paper (photo-sensitive paper). The apparatus further requires only easy adjustment thereof because it is not operated by skilled engineers (operators) differently from in the COM. In this respect, the conventional apparatus includes an image plane such as the exposure plane which cannot be viewed from the outside because it is located at the most important position within the apparatus, so that it is difficult to adjust the positions of the two pieces of information (synthetic positions in the exposure plane).

An object of the present invention is to provide an electrophotographic apparatus which is improved in the assembling and operations thereof and in the positional accuracy of the optical device, etc.

Another object of the present invention is to provide an electrophotographic apparatus capable of adjusting the respective image positions in the exposure plane of the images of the format and CRT.

Still another object of the present invention is to provide an electrophotographic apparatus capable of adjusting the respective images of the format and CRT for alignment therebetween with ease by eye.

In order to attain the above-mentioned objects, the present invention is intended to provide an electrophotographic apparatus in which components which require high accuracy in mounting such as an optical device, an exposure device, a paper feeding device, a CRT, a format, and so on are mounted on a frame assembly, and other components which require less accuracy in mounting are mounted on a base on which the frame assembly is mounted in a freely openable and closeable manner. Further, the frame assembly is opened in the focusing and adjusting operations to provide a visible exposure surface of an exposure device and provide easy access to focusing and adjusting means.

Further objects and advantages of the present invention will become more evident from examination of the drawings, wherein.

Figure 1:
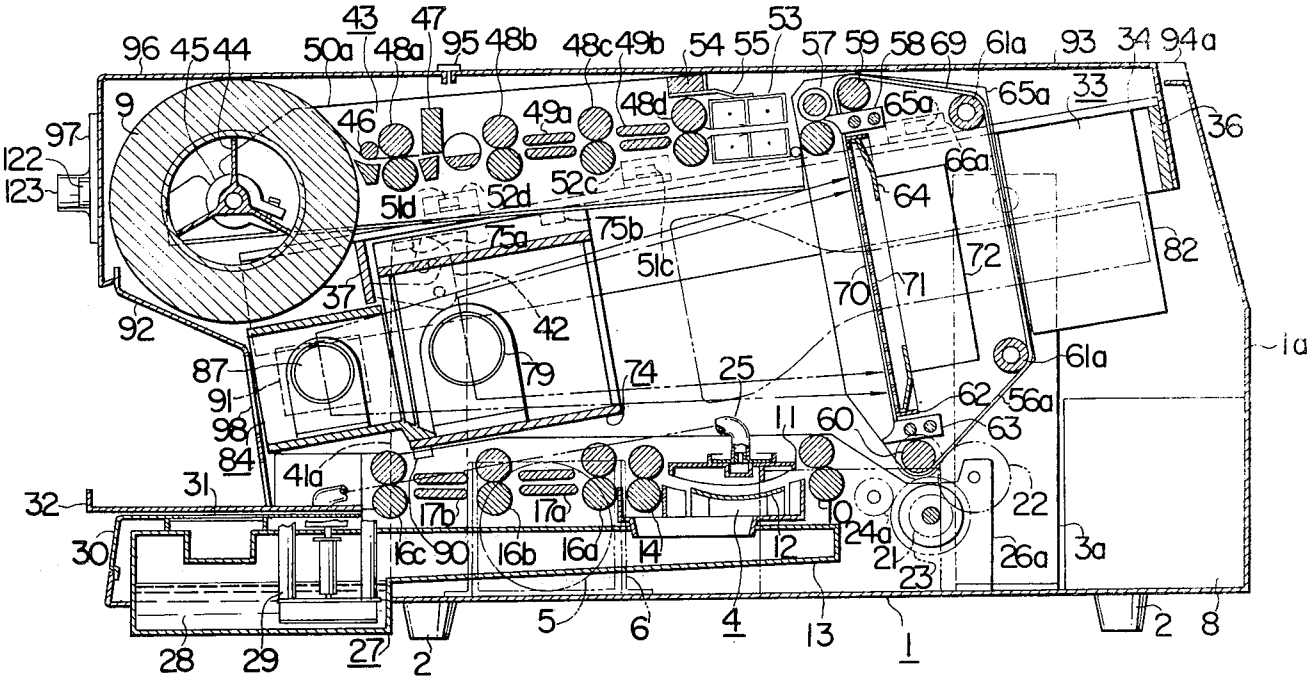
FIG. 1 is a vertical sectional view of essential portions of an electrophotographic apparatus according to the present invention.
Figure 2:
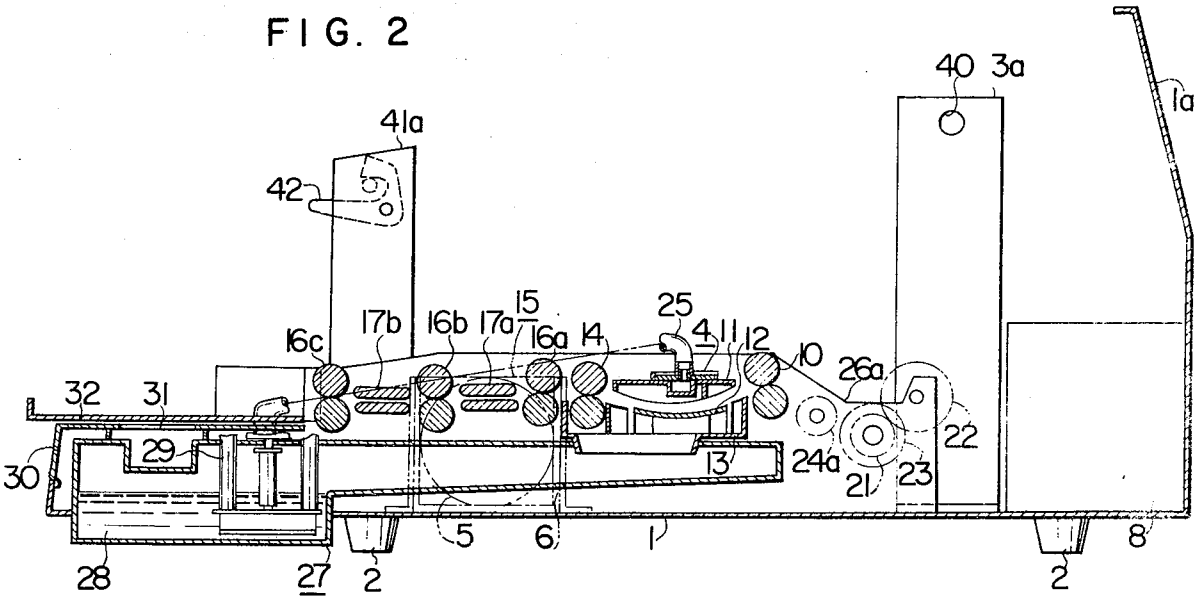
FIG. 2 is a vertical sectional view of a portion of the apparatus of FIG. 1 at the base side thereof.
Figure 3:
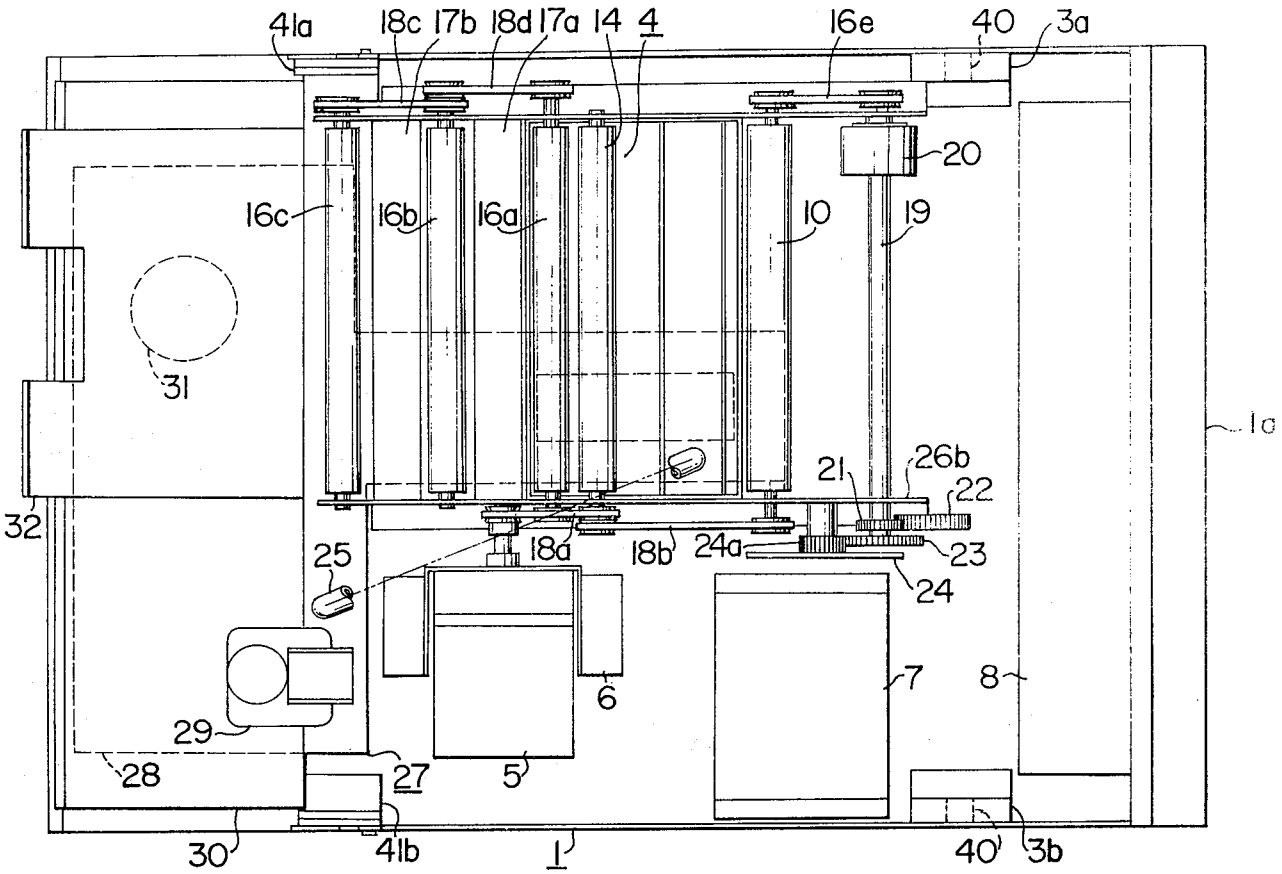
FIG. 3 is a plan view of the base of the electrophotographic apparatus.
Figure 4:
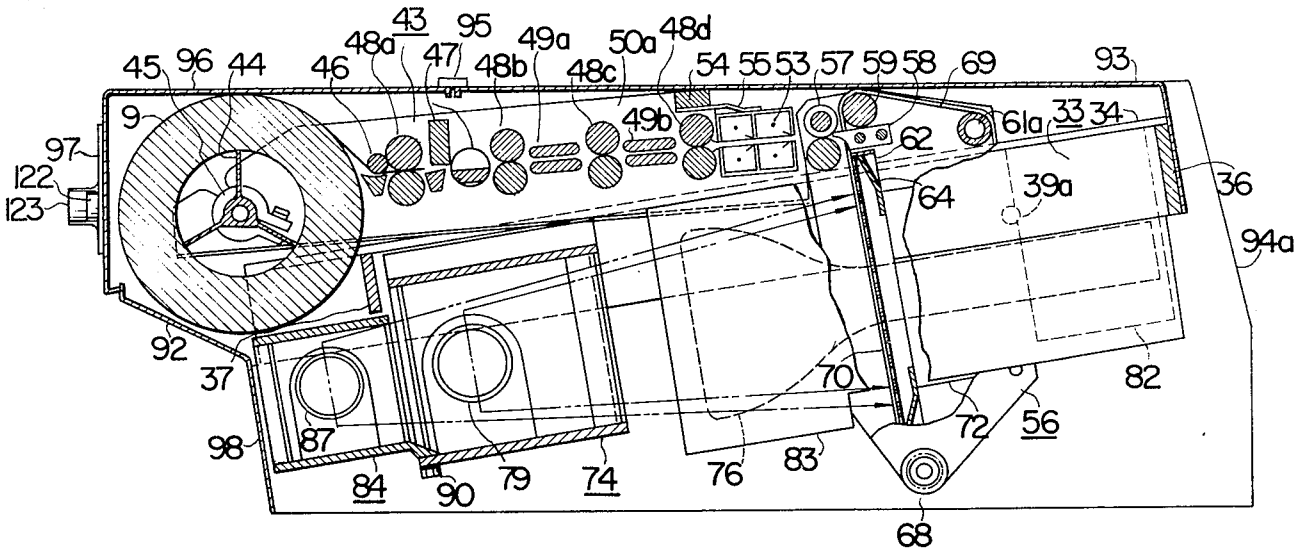
FIG. 4 is a vertical sectional view of a portion of the apparatus of FIG. 1 at the frame side thereof.

The present invention will be now described in detail in connection with the accompanying drawings. In the drawings, a rectangular base 1 is provided at its rear portion with an upright wall 1*a* and at its bottom with four legs 2 of rubber. Support columns 3*a*, 3*b* are provided on the opposite sides at the rear portions of the base 1. A developing device 4 is disposed at the central portion of the base 1 and fixed thereto by means of screws. A motor 5, driving the developing device 4, is disposed near the developing device 4. A support 6 secures the motor 5 to the base 1. A high voltage transformer 7 is disposed in the proximity of the motor 5 and fixed to the base support 1. A controlling device 8 for controlling the motor 5 is mounted on the base 1 at the rear thereof.

The developing device 4 comprises feed rollers 10 for feeding photosensitive paper 9, a shower case 11 for applying a developing liquid onto the photosensitive paper, a developing bath 12 disposed beneath the shower case 11, a developing case 13 disposed beneath the developing bath 12 for receiving an excess developing liquid, and squeezing rollers 14 for squeezing the liquid applied onto the photosensitive paper 9.

A fixing device 15 comprises fixing rollers 16*a*, 16*b*, 16*c* provided in the front of the squeezing rollers 14, and feed gides 17*a*, 17*b* provided between the fixing rollers 16*a*, 16*b*, 16*c*.

A belt 18*a* serves to transmit rotation from the motor 5 to the squeezing and fixing rollers 14 and 16*a* respectively; a belt 18*b* serves to transmit rotation of the squeezing roller 14 to the feed roller 10; a belt 18*c* serves to transmit rotation of the fixing roller 16*b* to the fixing roller 16*c*; a belt 18*d* serves to transmit rotation of the fixing roller 16*a* to the fixing roller 16*b*; and a belt 18*e* serves to transmit rotation from the feed roller 10 to a clutch roller 19 provided behind the feed roller 10. The clutch roller 19 is equipped with a clutch 20. A first gear 21 is provided at the edge portion of the clutch roller 19. An idler gear 22 comes into engagement with the first gear 21 and is adapted to engage with a gear for imparting rotation to a belt driving roller of an exposure device, as will be described hereinafter. A second gear 23 is provided at the edge portion of the clutch roller 19 to drive a gear 24 *a* of a pulse counter 24 which is disposed in the proximity of the feed roller 10. A liquid supply pipe 25 connects a pump described below with the shower case 11.

Side plates 26*a*, 26*b* are releasably mounted on the base 1 and integrally support the feed roller 10, shower case 11, developing bath 12, developing case 13, squeezing roller 14, fixing rollers 16*a*, 16*b*, 16*c*, feed guides 17*a*, 17*b*, 17*c*, belts 18*a*, 18*b*, 18*c*, 18*d*, 18*e*, clutch roller 19, clutch 20, first gear 21, idler gear 22, second gear 23, gear 24*a* for the pulse counter 24 and liquid supply pipe 25.

A tank unit 27 for storing the developing liquid comprises a tank portion 28, a pump 29 for circulating the liquid, a styled panel 30 covering the upper surface of the tank portion 28, and a supply opening 31 from which the liquid is supplemented into the tank portion 28, these components being formed integrally with each other so as to be pulled out together with the tank portion 28, when the latter is simply pulled out. A tray 32 is provided on the styled panel 30 to serve to receive a sheet of paper which is delivered from the fixing roller 16*c* and on which a desired image has been copied.

Figure 5:
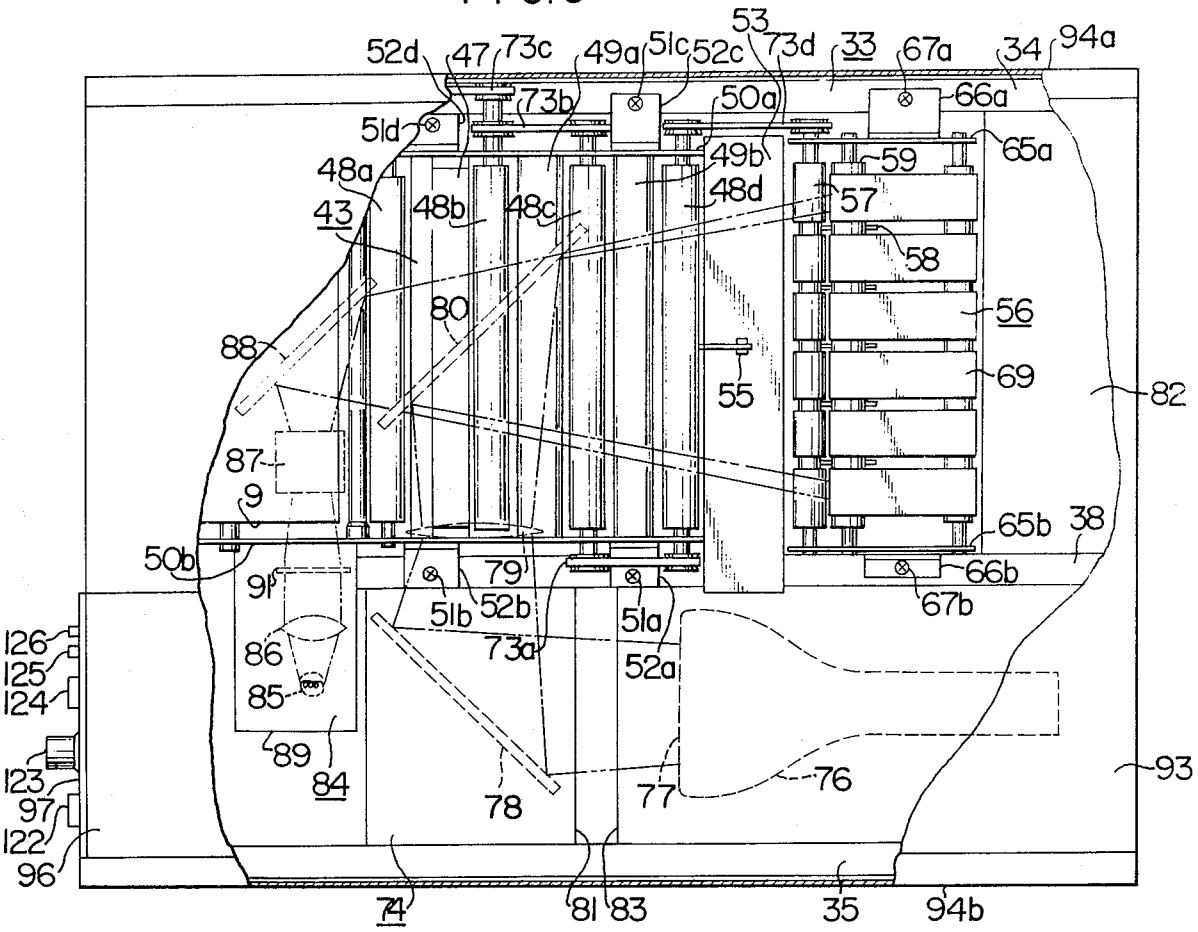
FIG. 5 is a plan view of the electrophotographic apparatus a portion of which is broken away at the frame side.

A rectangular frame assembly 33 made of a rigid body (see FIG. 5) comprises longitudinal frames 34, 35, lateral frames 36, 37 fixed at their ends to opposite ends of the longitudinal frames 34, 35, and a central frame 38 fixed to the lateral frames 36, 37 and disposed between the longitudinal frames 34, 35.

Pivot pins 39*a*, 39*b* are provided on the longitudinal frames 34, 35 and rotatably mounted in a mount hole 40 provided at the tip end of the support columns 3*a*, 3*b* so that the frame assembly 33 may be mounted on the base 1 in a freely openable and closeable manner. Columns 41*a*, 41*b* are provided on the base 1 at both side and in front of the base 1. Each of columns 41*a*, 41*b* is provided at its tip end with a hook 42. Corresponding to the respective hooks 42 on the longitudinal frames 34, 35 there are provided engaging fittings (not shown), which are brought into engagement with the hooks 42 in a state shown in FIG. 1. The releasing of the hooks 42 from the respective engaging fittings causes the frame assembly 33 to be opened upwardly about the pivot pins 39*a*, 39*b*. A stopper is provided on the frame assembly 33 or on the base 1 so that the frame assembly may be secured in a position where the lower surface of a paper feeding device 43 is to be substantially vertical.

The paper feeding device 43 is adapted to be disposed above the developing and fixing devices 4 and 15, respectively, when the frame assembly 33 is closed as shown in FIG. 1. The paper feeding device 43 comprises roll fittings 44 for holding the photosensitive paper wound therearound in rolls, a brake 45 provided at the edge of the shaft of rotation of the roll fittings, a guide rod 46 for positioning the insertion of the photosensitive paper 9 as well as removing the curl thereof, a cutter 47 for cutting off the photosensitive paper 9, feed rollers 48*a*, 48*b*, 48*c*, 48*d*, feed guides 49*a*, 49*b* provided between the feed rollers 48*a*, 48*b*, 48*c*, 48*d*, respectively, and side plates 50*a*, 50*b* for mounting thereon these components. Fittings 51*a*, 51*b*, 51*c*, 51*d* fixedly welded to the side plates 50*a*, 50*b* are fixed to the upper surface of the frame assembly 33 by means of screws 52*a*, 52*b*, 52*c*, 52*d* so that the paper feeding device 43 may be mounted on the upper surface of the frame assembly 33. The fittings 51*c*, 51*d* are mounted on the longitudinal frame 34, and the fittings 51*a*, 51*b* on the central frame 38.

A charging device 53 is located behind the paper feeding device 43 and mounted on a mount frame 54 provided between the side plates 50*a*, 50*b* by means of a fixing spring.

An exposure device 56 comprises a guide roller 57, a guide 58 cooperating with the guide roller 57 to change the direction of travel about 90° (turning it to a ⅂-shaped direction) of the photosensitive paper 9 from the paper feeding device 43, a belt roller 59, a belt driving roller 60, drum rollers 61*a*, 61*b*, a belt support 62, a guide 63 serving to change the direction of travel of the photosensitive paper 9 (turning it to a ⅃-shaped direction) about 90° to introduce it to the developing device 4, a fan base 64, and side plates 65*a*, 65*b* for mounting thereon these components. The exposure device 56 is mounted on the frame assembly 33 by means of fittings 66*a*, 66*b*. Screws 67*a*, 67*b* serve to mount the fittings 66*a*, 66*b* on the longitudinal frame 54 and the central frame 38, respectively.

The belt driving roller 60 is provided at its one end with a gear 68, which comes into engagement with the idler gear 22 to transmit rotation from the motor 5 through the belts 18*b*, 18*e* and the clutch roller 19 to the belt driving roller 60. A belt 69 is wound around the belt roller 59, the belt driving roller 66 and the drum rollers 61*a*, 61*b* to move in the trapezoid form depending on the rotation of the belt driving roller 66. The belt 69 has its one surface arranged perpendicular to the lower surface of the frame assembly 33 to form an exposure surface 70 when the frame assembly 33 is set to the base 1 as shown in FIG. 1. The exposure plane 70 is made horizontal upon the opening of the frame assembly 33 so as to permit direct view.

Within the belt 69 there is provided the belt base 62 so as to be in contact with the inner circumference of the belt 69. The belt base 62 is provided with a plurality of absorption holes 71, from which air is sucked by means of a fan 72 mounted in the belt 69 with the aid of the fan base 64 in order for the photosensitive paper 9 to adhere to the exposure plane of the belt 69. A belt 73*a* transmits rotation from the feed roller 48*d* to the feed roller 48*c*; a belt 73*b* transmits rotation from the feed rollers 48*c* to 48*b*; a belt 73*c* transmits rotation from the feed rollers 48*b* to 48*a*; and a belt 73*d* transmits rotation from the motor 5 to feed roller 48*d*, the turning on or off of the motor 5 causing the feed rollers 48*a*, 48*b*, 48*c*, 48*d* of the paper feeding roller 43 to be rotated or stopped by those belts 73*a* to 73*d*.

Figure 6:
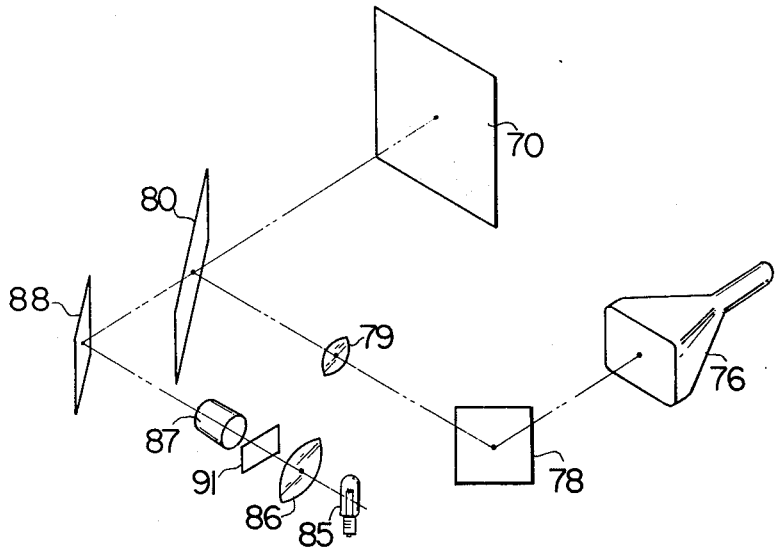
FIG. 6 is an illustrative view showing an arrangement of an optical system.
Figure 7:
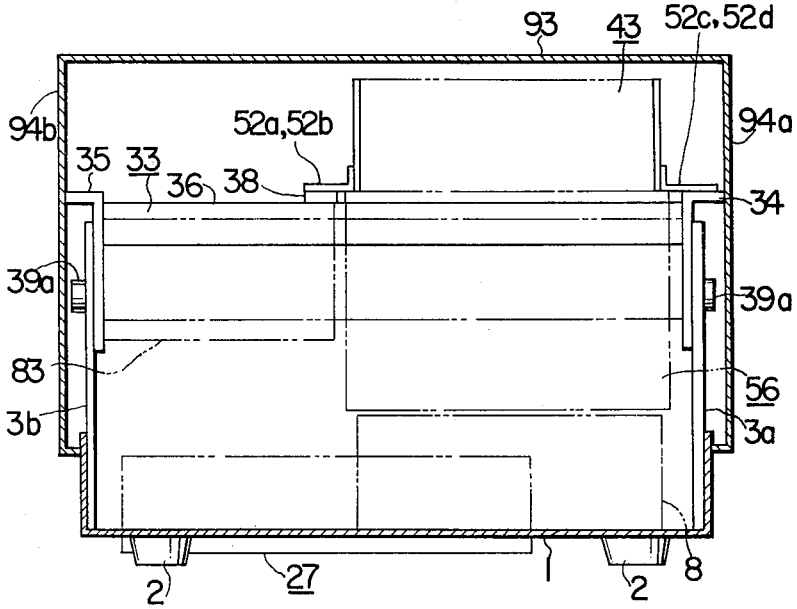
FIG. 7 is an illustrative view showing an arrangement of essential components viewed from a direction of an arrow P in FIG. 1.

A CRT optical device 74 is mounted on the lower surface of the longitudinal frames 34, 35 of the frame assembly 33 by means of screws 75*a*, 75*b*. A CRT 76 is mounted on the lower surfaces of the central and longitudinal frames 38 and 35 of the frame assembly. The CRT optical device 74 comprises a first mirror 78 for turning light from the CRT 76 by 90°, a lens 79 for focusing the light from the first mirror 78, a half-mirror 80 for turning the light from the lens 79 by 90° to direct it towards the exposure plane 70, and a cabinet 81 for receiving these components therein. These components of the CRT optical device 74, the CRT 76 and the exposure plane 70 are disposed in the horizontal plane so as to form substantially three rectangular sides, or a U-shaped arrangement, as shown in FIG. 6. A cabinet 82 for housing the controllers of the CRT 76 is disposed behind the exposure device 56 and mounted on the frame assembly 33 by means of screws. The CRT 76 is received in a cabinet 83, which is mounted on the frame assembly 33 with the aid of screws.

A format optical device 84 comprises a lamp 85, a first lens 86, a second lens 87, a half-mirror 88 and a cabinet 89 for receiving these components. These components of the format optical device 84 and the exposure plane 70 are disposed substantially in an L-shape position in the horizontal plane as shown in FIG. 6 so that the light turned 90 degrees by the half-mirror 88 may pass through the half-mirror 80 to impinge on the exposure plane 70. A screw 90 serves to mount the format optical device 84, and more particularly mount a cabinet 89 of the format optical device 84 on the cabinet of the CRT optical device 74.

A format 91 records thereon stationary information such as an inscribing frame for documents, and it is disposed between the first and second lenses 86, 87.

A front panel 92, top panel 93 and side panels 94*a*, 94*b* are mounted on the frame assembly to provide an upper case. Between the top panel 93 and front panel 92 there is partly disposed a cover 96 which is pivotally mounted by means of a hinge. Thus the cover 96 can be opened to mount the photosensitive paper 9. The top panel 93 is fixed at its top end to an operational panel 97. At the front panel 92 there is provided a slot 98, through which the format 91 is inserted for setting in the format optical device 84. The cabinet 89 of the format optical device 84 is formed with a housing for the format 91. The alignment of the exposure plane 70 with the format image can be attained only by a fine adjustment when the format 91 is received in the housing.

Figure 8:
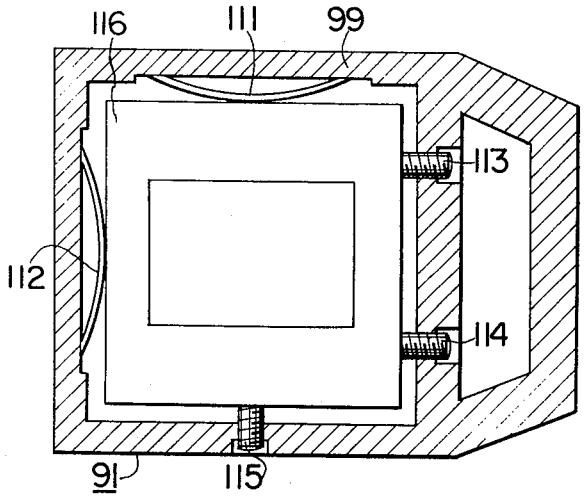
FIG. 8 is a vertical sectional view of essential portions showing one form of a format.
Figure 9:
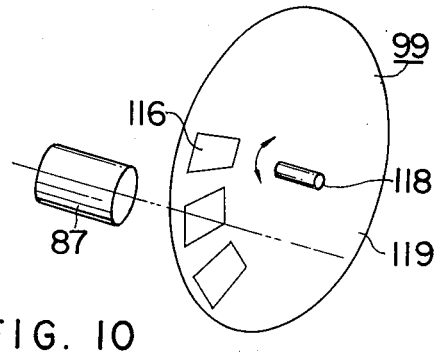
FIGS. 9 and 10 are perspective views of essential portions showing another form of a format.
Figure 10:
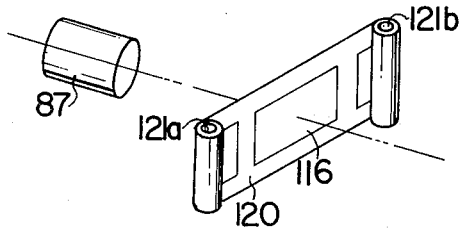

Embodiments of the format 91 will be described referring to FIGS. 8 to 10. In FIG. 8 the format is embodied by a slide magazine holding a slide 116 in a frame 99 by means of spring plates 111, 112 and adjusting screws 113, 114 and 115. In the use of this format 91, the screws 113, 114, 115 are adjusted to provide displacement of the slide 116 in the frame 99 for adjustment of an imaging position in the exposure plane 70. The frame 99 includes a gripper 117, which is used to set the format to the format optical device 84 through the slot 98. In FIG. 9, a plurality of sides 116 are disposed on a disk 119 fixed to a revolving shaft 118. The disk 119 is set in the CRT optical device 84 to adjust the imaging position in the exposure plane 70 by rotating the shaft 118 by predetermined amount. In FIG. 10, a plurality of sides 116 is disposed in succession on an elongated film stripe, which is wound around rollers 121*a*, 121*b* and set in the CRT optical device 84 to adjust the imaging position in the exposure plane 70 by rotating the rollers 121*a*, 121*b*. It is desirable that the adjustment is made through the operational panel 97 when a device is provided which is adapted to adjust the imaging position in the exposure plane 70 of the format image in a state where the format 91 is set to the format optical device 84.

On the operational panel 97 there are provided a push button for energizing the motor 5, a device 123 for setting the number of copy, various kinds of designations 124, a CRT operating button 125, and a button 126, for turning on the lamp 85.

In the thus arranged apparatus, the pushing of the push button 122 on the operational panel 97 causes the motor 5 and the fan 72 to be rotated to initiate the operations of the paper feeding device 43, the exposure device 56, the developing device 4 and the fixing device 15. The photosensitive paper 9 is cut off to a predetermined size by the cutter 47 and shifted to the charging device 53 to effect the charging operation.

The charged photosensitive paper 9 is turned about 90 degrees in the vertical direction by means of the guide roller 57, guide 58 and belt 69, and then set to the exposure plane 70.

When the photosensitive paper 9 has been set to the exposure plane 70, it is absorbed to the belt 69 by the fan 72 and at the same time the push button 122 is returned to stop the motor 5 and the fan 72. In this state, the CRT operating button is pushed to operate the CRT 76 to cause the photosensitive paper 9 on the exposure plane 70 to be exposed to the image of the CRT through the CRT optical device 74 for a predetermined period of time. Further, in this state, the button 126 for turning on the lamp 85 of the format optical device 84 to cause the photosensitive paper 9 on the exposure plane 70 to be also exposed to the image of the format through the half mirrors 88, 80, thereby forming thereon the latent images of the CRT and format.

The photosensitive paper formed with the latent images is turned 90 degrees by the guide 63 by re-starting the motor 5 to be transported to the developing bath 12 through the feed roller 10. The developing liquid is supplied by the pump 29 from the tank 28 through the liquid supply pipe 25 and the shower case 11 to the developing tank 12, and then it flows through the developing case 13 into the tank portion 28. Accordingly, the photosensitive paper 9 is formed with the visible image by the developing liquid as the paper is advanced into the developing bath 12.

The photosensitive paper 9 formed with the visible image is squeezed to remove the excess liquid therefrom by the squeezing roller 14, fixed by the fixing rollers 16*a*, 16*b*, and then delivered to the tray 32. Thus, the photosensitive paper 9 is advanced along the ]-shaped path to provide a copy of desired information.

In maintenance and inspection, the frame assembly 33 is opened to expose the developing device 4, the paper feeding device 43, the CRT 76, the CRT optical device 74 and the format optical device 84. The fixing screws are removed for each component for replacement with another. In assembling operations, each component is previously assembled to form a unit, which is then assembled on the opened frame assembly 33.

The alignment of the format image with the imaging position of the CRT image in the exposure plane 70 is made first by opening the frame assembly 33 to expose the exposure plane 70 and then focusing the respective images of the CRT 76 and the format 71 on the exposure plane 70 to thereby adjust the position of the format 91 viewing the images by eye. The positioning of the format 91 may be made by turning the adjusting screws 113, 114, 115 to displace the slide 116.

In a fault such as jamming, the frame assembly is opened to expose the lower surface of the paper feeding device 43 and the upper surface of the exposure device 4 with the result of easy removal of the jammed paper by the operator.

The replacement of the photosensitive paper 9 with another and the mounting thereof may be made by opening the cover 96 and mounting it on the roll fittings 44 and dismounting it therefrom, respectively.

The supplementation of the developing liquid is made by withdrawing the tank unit 27 and pouring in the liquid from the supply aperture 31 to the tank portion 28.

Those parts which require precise positioning relative to each other in assembly, such as the paper feeding device 43, the CRT optical device 74, the CRT 76, the format optical device 84 and the exposure device 56, are mounted as a unit on the frame assembly, so that the precise mutual positioning is assured. Without assembling the whole, when only the CRT optical device 74, CRT 76, format optical device 84 and the exposure device have been mounted on the frame assembly 33 for optical adjustment, optical adjustment can be made, thus resulting in the ease of adjustment.

As mentioned above, the driving operations, replacement of the components such as the photosensitive paper 9, supplementation of the developing liquid, maintenance and inspection are made in the front of the apparatus with remarkable improvement in operating conditions.

What is claimed is:

1. A electrophotographic apparatus comprising base means having a forward portion and a rearward portion, and including supporting column means provided on an upper surface of said base means at said rearward portion thereof;

frame means pivotally mounted on said supporting column means for movement to open and closed positions;

paper feeding means provided on said frame means opposite said forward portion of said base means;

charging means provided on said frame means at the rear of said paper feeding means;

exposure means provided on said frame means at the rear of said charging means;

a cathode ray tube provided on said frame means alongside said charging means and said exposure means;

cathode ray tube optical means, provided on said frame means adjacent to said cathode ray tube, for focussing an image from said cathode ray tube on an exposure plane of said exposure means;

format support means, provided at a forward portion of said frame means, for supporting a format;

format optical means, provided on said frame means adjacent to said format support means, for focussing an image from a format supported by said format support means on said exposure plane of said exposure means;

a tray provided at a forward portion of an upper surface of said base means;

fixing means provided on said base means at the rear of said tray;

developing means provided on said base means at the rear of said fixing means;

an electric motor provided on said base means alongside said developing means and said fixing means;

control means, provided on said base means adjacent to said motor, for controlling said motor; and adjusting means for enabling the manual adjustment of the focus of an image from a format supported by said format support means on said exposure plane.

2. An electrophotographic apparatus according to claim 1, further comprising an upper case means mounted on said frame means, said upper case means including a front panel, a top panel and a plurality of side panels, and a cover pivotally mounted between said top panel and said front panel for movement to open and closed positions, wherein paper can be mounted on said paper feeding means when said cover is in its open position.

3. An electrophotographic apparatus according to claim 1, wherein said charging means includes means for effecting a charge on paper fed from said paper feeding means; and said exposure means includes means for guiding the charged paper to travel in a direction substantially perpendicular to the direction in which the paper fed from said paper feeding means travels, and further means for guiding the charged paper to travel in a direction substantially parallel and opposite to said direction in which the paper fed from said paper means travels.

4. An electrophotographic apparatus according to claim 3, wherein said developing means includes means for applying developing material onto the charged paper as it travels along said direction substantially parallel and opposite to said direction in which the paper fed from said paper feeding means travels; said fixing means includes delivering means for delivering to said tray the charged and exposed paper applied with said developing material; and said control means includes belt means coupled to said motor and to each of said paper feeding means, said exposure means, and fixing means and said developing means for advancing said paper fed from said paper feeding means to said tray.

5. An electrophotographic apparatus according to claim 4, further including tank means provided beneath said tray on said base means for storing said developing material, said tank means including a pump means mounted therein for supplying said developing material to said developing means.

6. An electrophotographic apparatus according to claim 1, wherein said cathode ray tube optical means comprise first mirror means for reflecting an image from said cathode ray tube by a first predetermined angle, first lens means for focussing the image reflected by said first mirror means, and second mirror means for reflecting the image focussed by said first lens means by a second predetermined angle towards said exposure plane of said exposure means.

7. An electrophotographic apparatus according to claim 6, wherein said format optical means comprises means for illuminating an image of a format support by said format support means, second lens means for focussing the image illuminated by said means for illuminating, third mirror means for reflecting the image focussed by said second lens means by a third predetermined angle toward said exposure plane of said exposure means through said second mirror means.

8. An electrophotographic apparatus according to claim 7, wherein said first, second and third predetermined angles are each substantially 90°.

9. An electrophotographic apparatus according to claim 1 wherein said adjusting means includes a portion positioned in front of said frame means and includes means for changing the position of a format supported in said format support means.

* * * * *